US011213088B2

(12) United States Patent
McGuckin, Jr.

(10) Patent No.: US 11,213,088 B2
(45) **Date of Patent: *Jan. 4, 2022**

(54) HELMET WITH VARYING SHOCK ABSORPTION

(71) Applicant: Rex Medical, L.P., Conshohocken, PA (US)

(72) Inventor: James F. McGuckin, Jr., Radnor, PA (US)

(73) Assignee: Rex Medical, L.P., Conshohocken, PA (US)

( * ) Notice: Subject to any disclaimer, the term of this patent is extended or adjusted under 35 U.S.C. 154(b) by 26 days.

This patent is subject to a terminal disclaimer.

(21) Appl. No.: 16/422,670

(22) Filed: May 24, 2019

(65) Prior Publication Data

US 2019/0274389 A1 Sep. 12, 2019

Related U.S. Application Data

(63) Continuation of application No. 14/604,548, filed on Jan. 23, 2015, now Pat. No. 10,327,496.

(60) Provisional application No. 61/991,463, filed on May 10, 2014, provisional application No. 61/940,407, filed on Feb. 15, 2014.

(51) Int. Cl.
*A42B 3/12* (2006.01)

(52) U.S. Cl.
CPC ..... *A42B 3/122* (2013.01); *A42B 3/121* (2013.01); *A42B 3/125* (2013.01); *A42B 3/128* (2013.01)

(58) Field of Classification Search
CPC ..... A42B 3/128; A42B 3/122; A42B 3/125; A42B 3/121
USPC ..... 2/413, 411
See application file for complete search history.

(56) References Cited

U.S. PATENT DOCUMENTS

| | | | | |
|---|---|---|---|---|
| 3,713,640 | A | 1/1973 | Margan | |
| 4,012,794 | A | 3/1977 | Nomiyama | |
| 5,669,079 | A | 9/1997 | Morgan | |
| 5,950,244 | A * | 9/1999 | Fournier | A42B 3/128 2/411 |
| 5,978,972 | A | 11/1999 | Stewart et al. | |
| 6,446,270 | B1 | 9/2002 | Durr | |
| 6,720,878 | B2 | 4/2004 | Jumpertz | |
| 6,798,392 | B2 | 9/2004 | Hartwell et al. | |

(Continued)

FOREIGN PATENT DOCUMENTS

| | | |
|---|---|---|
| GB | 2404328 | 2/2005 |
| WO | WO-96/14768 | 5/1996 |
| WO | WO-98/19571 | 5/1998 |

OTHER PUBLICATIONS

Extended European Search Report Application No. 15153887.3 dated Jul. 15, 2015.

(Continued)

*Primary Examiner* — Nathan E Durham
*Assistant Examiner* — Abby M Spatz
(74) *Attorney, Agent, or Firm* — Neil D. Gershon

(57) ABSTRACT

A helmet including a body, an outer shell having an inner surface and an outer surface and a plurality of shock absorbers, the shock absorbers being positioned internal of the outer shell. A first set of shock absorbers has a first shock absorption characteristic and a second set of shock absorbers has a second shock absorption characteristic, the second shock absorption characteristic being different than the first shock absorber.

8 Claims, 9 Drawing Sheets

(56) References Cited

U.S. PATENT DOCUMENTS

| | | | | |
|---|---|---|---|---|
| 6,978,162 | B2 | 12/2005 | Russell et al. | |
| 7,093,305 | B2 | 8/2006 | Reilly et al. | |
| 7,254,843 | B2 | 8/2007 | Talluri | |
| 7,401,365 | B2 | 7/2008 | Neal et al. | |
| 7,509,835 | B2 | 3/2009 | Beck | |
| 7,526,389 | B2 | 4/2009 | Greenwald et al. | |
| 7,570,170 | B2 | 8/2009 | Wallner | |
| 8,382,685 | B2 | 2/2013 | Vaccari et al. | |
| 8,537,017 | B2 | 9/2013 | Mack | |
| 8,554,495 | B2 | 10/2013 | Mack | |
| 8,702,516 | B2 | 4/2014 | Bentley | |
| 8,814,150 | B2 * | 8/2014 | Ferrara | F16F 1/376 267/139 |
| 8,860,570 | B2 | 10/2014 | Thomas | |
| 8,930,144 | B2 | 1/2015 | Hubler | |
| 2002/0060633 | A1 | 5/2002 | Crisco, III et al. | |
| 2003/0007936 | A1 | 1/2003 | Robinson | |
| 2003/0140401 | A1 | 7/2003 | Ku | |
| 2004/0117896 | A1 | 6/2004 | Madey | |
| 2004/0250340 | A1 * | 12/2004 | Piper | A42B 3/064 2/411 |
| 2005/0177929 | A1 | 8/2005 | Greenwald | |
| 2006/0038694 | A1 | 2/2006 | Naunheim | |
| 2007/0209098 | A1 | 9/2007 | Peart | |
| 2008/0256687 | A1 | 10/2008 | Spencer | |
| 2010/0307223 | A1 | 12/2010 | Jeftic-Stojanovski | |
| 2011/0098934 | A1 | 4/2011 | Hubler | |
| 2011/0117310 | A1 | 5/2011 | Anderson | |
| 2011/0181420 | A1 | 7/2011 | Mack | |
| 2011/0184663 | A1 | 7/2011 | Mack | |
| 2012/0096631 | A1 | 4/2012 | King et al. | |
| 2012/0124720 | A1 | 5/2012 | Evans et al. | |
| 2012/0198604 | A1 * | 8/2012 | Weber | A42B 3/125 2/414 |
| 2012/0210498 | A1 | 8/2012 | Mack | |
| 2012/0223833 | A1 | 9/2012 | Thomas | |
| 2012/0304367 | A1 * | 12/2012 | Howard | A42B 3/046 2/413 |
| 2013/0013243 | A1 | 1/2013 | Levine | |
| 2013/0060168 | A1 | 3/2013 | Chu et al. | |
| 2013/0074248 | A1 | 3/2013 | Evans et al. | |
| 2013/0110415 | A1 | 5/2013 | Davis et al. | |
| 2013/0185837 | A1 * | 7/2013 | Phipps | A42B 3/20 2/2.5 |
| 2013/0271602 | A1 | 10/2013 | Bentley | |
| 2013/0282308 | A1 | 10/2013 | Mack et al. | |
| 2014/0000011 | A1 * | 1/2014 | Johnson | A42B 3/046 2/413 |
| 2014/0173810 | A1 | 6/2014 | Suddaby | |
| 2014/0345036 | A1 | 11/2014 | Sargenti | |
| 2015/0285832 | A1 | 10/2015 | Thomas | |

OTHER PUBLICATIONS

Extended European Search Report Application No. 15153888.1 dated Jul. 13, 2015.

* cited by examiner

HELMET WITH VARYING SHOCK ABSORPTION

This application is a continuation of U.S. application Ser. No. 14/604,548, filed on Jan. 23, 2015, which claims the benefit of provisional application Ser. No. 61/991,463, filed May 10, 2014, and provisional application Ser. No. 61/940,407, filed Feb. 15, 2014. The entire contents of each of these applications are incorporated herein by reference.

BACKGROUND

Technical Field

This application relates to a helmet and more particularly to a helmet having varying shock absorption capabilities.

Background of Related Art

Head injuries in sports are becoming more prevalent. Part of the reason for such increase in incidence of injuries is that helmets provide a false sense of security and are therefore used offensively in contact sports such as football. When two helmets crash together, full force transmission occurs, leading to concussions and more severe head injuries.

Additionally, current helmets are heavy, which adds to the discomfort. Such heaviness further adds to the false sense of security, creating a mistaken correlation between helmet weight and protection.

Current helmets are built with some shock absorption features, but such shock absorption does not vary depending on the force of impact.

There exists a need for improved helmets to reduce head injuries. It would also be advantageous to provide such injury reducing capabilities without increasing the weight and/or stiffness of the helmet.

SUMMARY

The present invention overcomes the problems and disadvantages of the prior art. In one aspect, the present invention provides a helmet comprising a body, an outer shell having an inner surface and an outer surface and a plurality of shock absorbers, the shock absorbers being positioned internal of the outer shell. At least one shock absorber has a first shock absorption characteristic and at least another shock absorber has a second shock absorption characteristic, the second shock absorption characteristic being different than the first shock absorption characteristic.

Preferably, the at least one shock absorber includes a first set of shocking absorbers having the first shock absorption characteristic and the at least another shock absorber includes a second set of shock absorbers having the second shock absorber characteristic.

In some embodiments, the shock absorbers are composed of a compressible foam material. In some embodiments, the shock absorbers comprise air cells forming an air pocket. The air cells can include a relief valve to allow force deceleration and pressure release when a pressure threshold is exceeded. In some embodiments, the shock absorbers of the first set have a first height and the shock absorbers of the second set have a second height, the first height being greater than the second height.

In some embodiments, the outer shell spins or rotates with respect to the helmet body to release energy to a side. The outer shell can have a low friction outer surface to deflect impact to the helmet.

In some embodiments, the first shock absorption characteristic provides a lower activation threshold than the second shock absorption characteristic such that activation of the first and second sets of shock absorbers is dependent on the force impact to the helmet, thus accommodating different impact forces. In some embodiments, the gradient of stress absorption differs between first and second sets of shock absorbers.

The helmet can include a third set of shock absorbers having a gradient of stress absorption different than the gradient of the first set of shock absorbers and the second set of shock absorbers thereby providing successive loading based on severity of force impact to the helmet.

In accordance with another aspect, the present invention provides a helmet for diffusing and dispersing a force provided by an impact to the helmet. The helmet comprises a body, an outer shell and a plurality of shock absorbing members positioned internal of the outer shell. An outer surface of the shell has a low friction surface to deflect the force to the helmet by aiding glancing rather than a direct hit. The shock absorbing members have a varying gradient of shock absorption to provide successive loading based on severity of the force impact. The outer shell is rotatable with respect to the body to minimize direct hit impact.

In some embodiments, the plurality of shock absorbing members comprises a first set of shock absorbers having a first shock absorption characteristic and a second set of shock absorbers having a second shock absorption characteristic, the first shock absorption characteristic provides a lower activation threshold than the second shock absorption characteristic such that activation of the first and second sets of shock absorbers is dependent on the force impact to the helmet.

In some embodiments, the shock absorbing members comprise air cells forming an air pocket. The air cells can include a relief valve to allow force deceleration. In some embodiments, shock absorbers are composed of a compressible foam material. In some embodiments, the shock absorbing members include a first set of shock absorbers have a first height and a second set of shock absorbers having a second height, the first height being greater than the second height.

In accordance with another aspect, the present invention provides a force deflector and energy diffuser for mounting to a helmet comprising a first set of shock absorbers having a first shock absorption characteristic and a second set of shock absorbers having a second shock absorption characteristic. The first shock absorption characteristic provides a lower activation threshold than the second shock absorption characteristic such that activation of the first and second sets of shock absorbers is dependent on the force impact to the helmet.

In some embodiments, the first and second sets of shock absorbers are composed of a compressible foam material. In some embodiments, the shock absorbers comprise air cells forming an air pocket. In some embodiments, the shock absorbers of the first set have a first height and the shock absorbers of the second set have a second height, the first height being greater than the second height. In some embodiments, the force deflector and energy diffuser is removably mountable to the helmet.

BRIEF DESCRIPTION OF THE DRAWINGS

Preferred embodiment(s) of the present disclosure are described herein with reference to the drawings wherein.

DETAILED DESCRIPTION OF PREFERRED EMBODIMENTS

Figure 1:
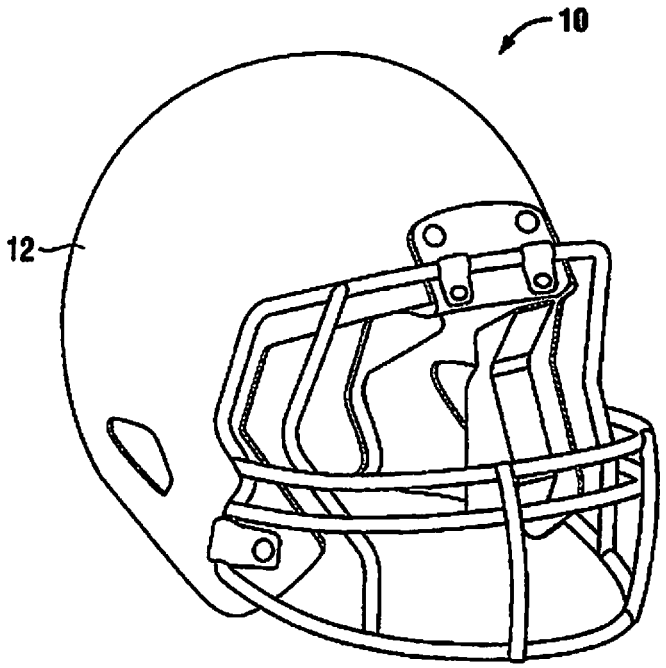
FIG. 1 (Prior Art)
FIG. 1 is a perspective view of a helmet of the prior art having a hard outer shell and soft inner padding.

FIG. 1 illustrates a football helmet of the prior art. The helmet 10 has a hard outer shell 12 and soft padding inside the shell 12. The helmet 10 is relatively heavy and relies on the soft padding inside to cushion the head in an attempt to reduce brain injuries. However, the weight of the helmet makes the helmet cumbersome and uncomfortable to wear. The heavy weight can also adversely affect athletic performance.

Additionally, the padding inside the helmet does not provide adequate protection to the head, especially since the heavy helmet provides the wearer with a false sense of protection. This false sense of protection oftentimes lead to more head injuries since the helmet is used offensively as the wearer uses the helmet as a direct force against an opponent, and the wearer will incur direct impacts on the helmet.

Moreover, the amount of padding that can be provided in the helmet of the prior art is limited by the size of the helmet since if thicker padding is utilized it will take up more internal space, leading to even larger and more cumbersome helmet. Additionally, if such additional padding/cushioning is added, it would need to be sufficient to handle all impacts, regardless of the force. Therefore, the helmet would need to be designed with thicker cushioning throughout, even if not necessary to handle small impact forces. Also, if the helmet is designed solely to accommodate maximum impact, it will be stiffer and "bumpier" on the user's head.

The present invention advantageously provides a lightweight helmet without sacrificing effectiveness in injury prevention. This is achieved through the varying shock absorbers (shock absorbing members) lining the helmet. Additionally, the helmet is designed in certain embodiments so that upon certain impact forces, the outer shell spins with respect to the helmet body, thus further dispersing the force of the impact.

Figure 2A:
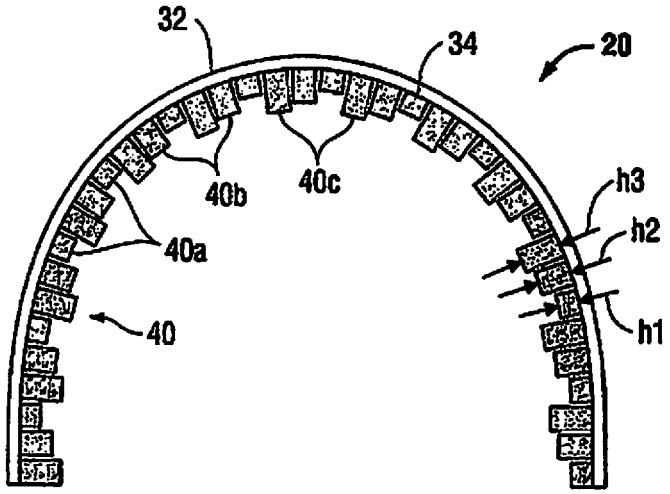
FIG. 2A is a front view of a first embodiment of the inner (inside) liner of the helmet of a first embodiment of the present invention.
Figure 2B:
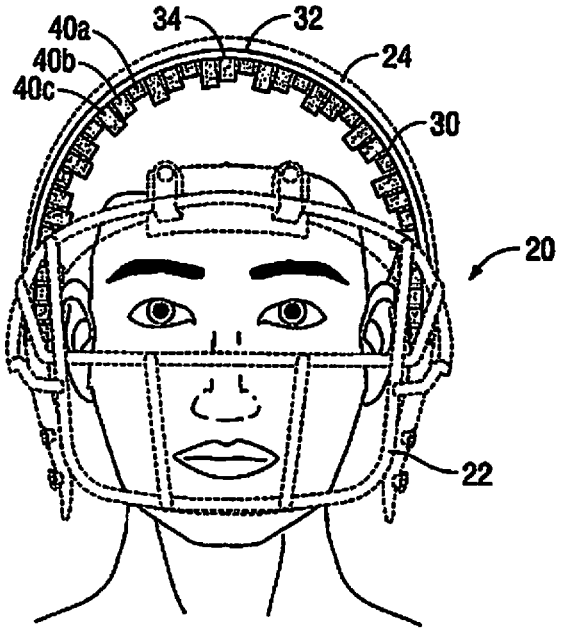
FIG. 2B is an enlarged front view of the helmet of the first embodiment of the present invention with portions removed to show the inner liner of FIG. 2A.
Figure 3:
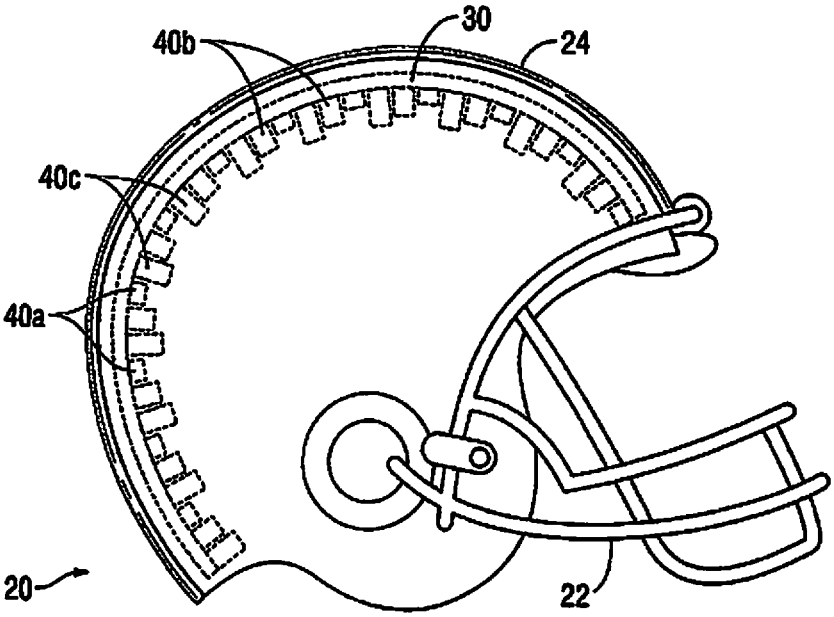
FIG. 3 is a side view of the helmet of FIG. 2B.

Turning now to the drawings, wherein like reference numerals identify similar or like components throughout the several views, FIGS. 2A-3 illustrate a first embodiment of the helmet of the present invention. The helmet is designated generally by reference number 20 and has a conventional face guard 22. Inside the outer shell 24 of the helmet 20 is an inner liner 30 which forms the shock absorbing feature of the present invention. Inner liner 30 has an upper surface 32 which is attached to the inner surface of the outer shell 24 and a lower surface 34 from which the shock absorbers 40 extend.

Shock absorbers in the embodiment of FIGS. 2A-3 are composed of a compressible foam material with sufficient flexibility and rigidity to receive and disperse a force applied thereto. The shock absorbers 40 are of varying height and of varying compressibility thereby providing different shock absorbing characteristics with different activation thresholds. In the embodiment of FIGS. 2A-3, there are three sized shock absorbers with shock absorbers 40*a* of the smallest height h1 having a first shock absorption characteristic, shock absorbers 40*c* of the largest height h3 having a second shock absorption characteristic and shock absorbers 40*b* of an intermediate height h2 having a third shock absorption characteristic. Height h2 is greater than height h1 and less than height h3. The shock absorbers 40*a*, 40*b* and 40*c* are collectively referred to as shock absorbers 40. For clarity, only some of the shock absorbers 40*a*, 40*b* and 40*c* are labeled throughout the drawings. It can be appreciated that shock absorbers of more than three differing heights can be provided. It is also contemplated that shock absorbers of only two different heights can be provided. In any event, the liner will have at least one shock absorber, and preferably a first set of shock absorbers, having a first shock absorption characteristic, and at least another shock absorber, and preferably a second set of shock absorbers, having a second shock absorption characteristic different than the first shock absorption characteristic. Also, the shock absorbers 40 can be arranged in a pattern or grouping different than the alternating pattern shown in FIGS. 2A-3. As noted above, shock absorbers 40 can be formed of a compressible foam material which compresses upon sufficient impact. However, other cushioning materials are also contemplated.

Figure 5A:
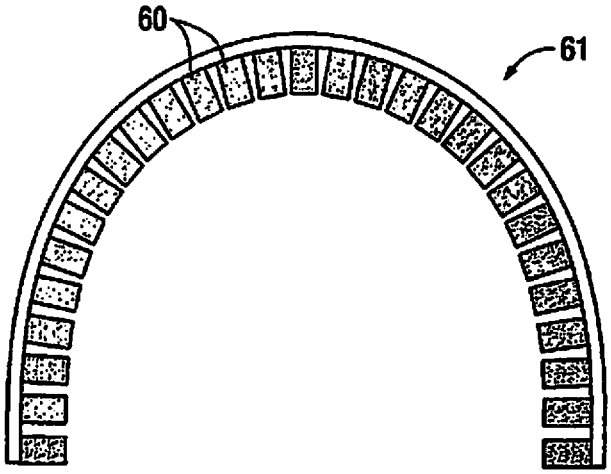
FIG. 5A is a front view of an alternate embodiment of the inner liner of the helmet of the present invention having equally sized shock absorbers.
Figure 5B:
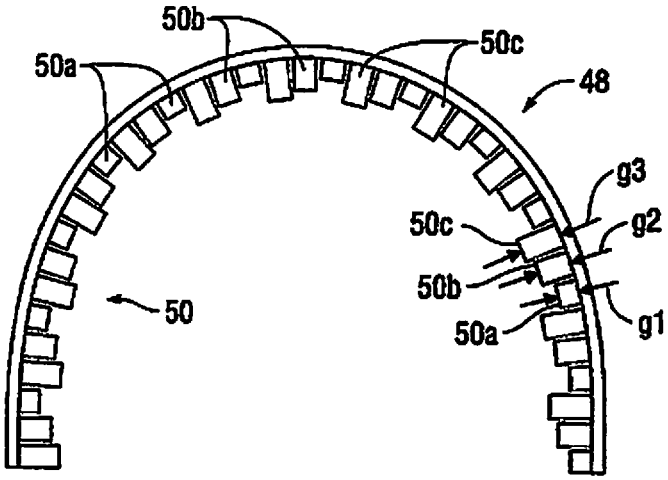
FIG. 5B is a front view of another alternate embodiment of the inner liner of the helmet of the present invention having shock absorbers of varying heights.

In the alternate embodiment of FIG. 5B, the shock absorbers 50 of inner liner 48 include shock absorbers 50*a* of the smallest height g1, shock absorbers 50*c* of the largest height g3 and shock absorbers 50*b* of an intermediate height g2 which is greater than height g1 and less than height g3. The shock absorbers 50*a*, 50*b* and 50*c* are collectively referred to as shock absorbers 50. For clarity only some of the shock absorbers 50*a*, 50*b*, and 50*c* are labeled in FIG. 5B. In this embodiment, the shock absorbers comprise air cells rather than a foam material as in FIG. 2A, and the air cells can include a relief valve. In all other respects the shock absorbing feature of FIG. 5A is identical to that of FIG. 2A and is used in a similar helmet as that shown in FIG. 2B. As can be appreciated, as explained above with respect to the embodiment of FIG. 2A, although three sets of varying shock absorbers arranged in an alternating pattern are shown, a different number of sets of varying shock absorbers and/or a different pattern is contemplated.

Figure 6:
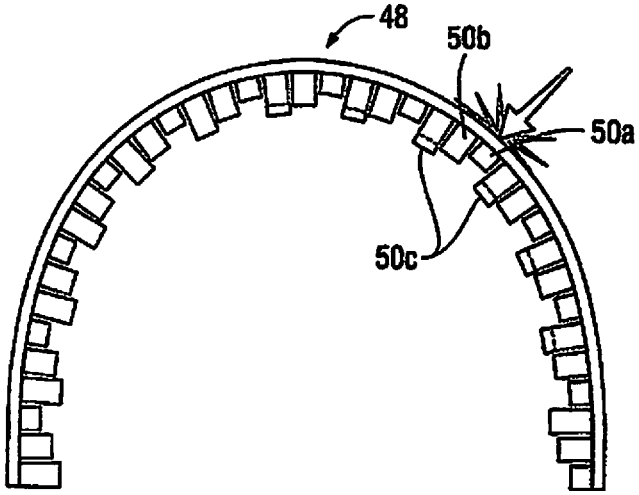
FIG. 6 is a front view of the inner liner of FIG. 5B showing the effect upon a small impact force on the helmet.
Figure 7:
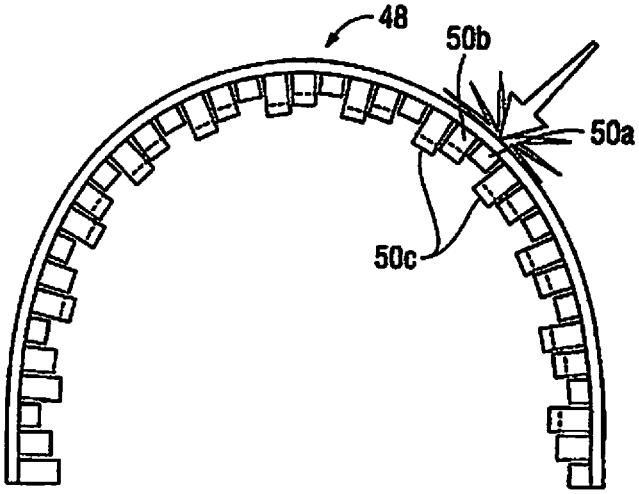
FIG. 7 is a front view of the inner liner of FIG. 5B showing the effect upon a medium impact force on the helmet.
Figure 8:
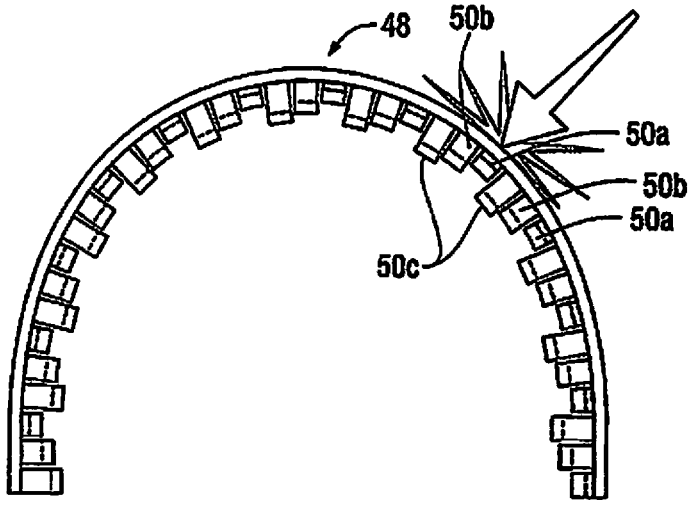
FIG. 8 is a front view of the inner liner of FIG. 5B showing the effect upon a large impact force on the helmet.

FIGS. 6-8 illustrate what occurs upon impact of varying forces on the helmet. Although FIGS. 6-8 illustrate the inner liner 48 of FIG. 5B, the inner liner 30 of FIG. 2A would function and react in the same manner as shown in FIGS. 6-8. The shock absorbers 50 (like shock absorbers 40) of varying heights have different gradients of stress absorption and therefore different thresholds for activation and provide successive loading dependent on severity of force impact. Consequently, if a relatively small impact force is applied to the helmet as shown in FIG. 6, only a few of the shock absorbers would be activated, i.e., shock absorbers 50*c* which have the most flexibility and lowest activation threshold. If a greater impact is applied to the helmet as in FIG. 7, both the larger shock absorbers 50*c* and the intermediate shock absorbers 50*b* would be affected and activated. If an even larger impact is applied as in FIG. 8, smaller shock absorbers 50*a* would also be impacted as shock absorbers 50*a* have the smallest height, least flexibility and highest activation threshold. That is, all sized absorbers 50 would be activated to absorb and disperse the force. In this manner, only those shock absorbers necessary to absorb the shock would be activated, allowing for a series of smaller shock absorbers, taking up less room in the helmet and also reducing the weight of the helmet than would otherwise be necessary. Note shock absorbers 40 would be activated in the same manner as shock absorbers 50, i.e., dependent on impact force.

It should be appreciated that in FIGS. 6-8, multiple or all of the shock absorbers 50 are shown impacted, however depending on the impact, only certain shock absorbers 50*a*, 50*b*, and 50*c* would be affected. For example, in certain instances, only the shock absorbers in the region of impact would be affected/activated. On sufficient impact, it is also possible that all shock absorbers of the liner 48 would be affected/activated. This is also applicable to liner 30 and shock absorbers 40 as well as the other shock absorbers disclosed herein, e.g., shock absorbers 60 and 70 described below.

In the embodiment of FIG. 5A, the shock absorbers 60 of inner liner 61 are of the same height but varying shock absorption is achieved by providing different materials. The embodiment of FIG. 5A can have the same advantages of reduced bulk as in the previously described embodiments achieved by varying the lightness of the material. It also has the advantage of varying shock absorption, wherein only a fraction of the shock absorbing elements are activated upon application of a relatively low force, i.e., the shock absorbers with the greatest flexibility/compressibility, and more shock absorbers are activated with application of a higher force i.e., including the shock absorbers having less flexibility/compressibility. Such varying shock absorption can be achieved using a pattern similar to that of the embodiments of FIG. 2A and 5B, e.g., three sets of shock absorbers of different shock absorption characteristics arranged in an alternating pattern with a first set of first flexibility/compressibility, a second set of a different, e.g., less flexibility/compressibility and a third set of still different, e.g., even less flexibility/compressibility. It should be appreciated that as in the aforedescribed embodiments, a different number of sets of varying shock absorbers and/or different patterns of the varying shock absorbers are also contemplated.

In some embodiments, the shock absorbers of the various embodiments described herein can contain material such as foam. Alternatively the shock absorbers can contain a fluid with a relief valve for releasing pressure when the pressure is greater than a pressure threshold to reduce the effects of impact to the head. The relief valves allow for force deceleration and would have different thresholds for release to provide shock absorbers of varying shock absorption characteristics. In other embodiments, some of the shock absorbers can contain compressible surfaces such as foam and other shock absorbers can contain fluid with a relief valve.

Thus, the shock absorbers in accordance with the present disclosure can have different configurations, different heights and/or different materials to accommodate different forces, thus providing differential protection. They can be arranged in an alternating arrangement or grouped together in a different pattern. They can be arranged in two or more sets of varying shock absorption characteristics and can be evenly or unevenly distributed. The number of shock absorbers for each set can be the same or alternately a different number in each set.

Figure 9:
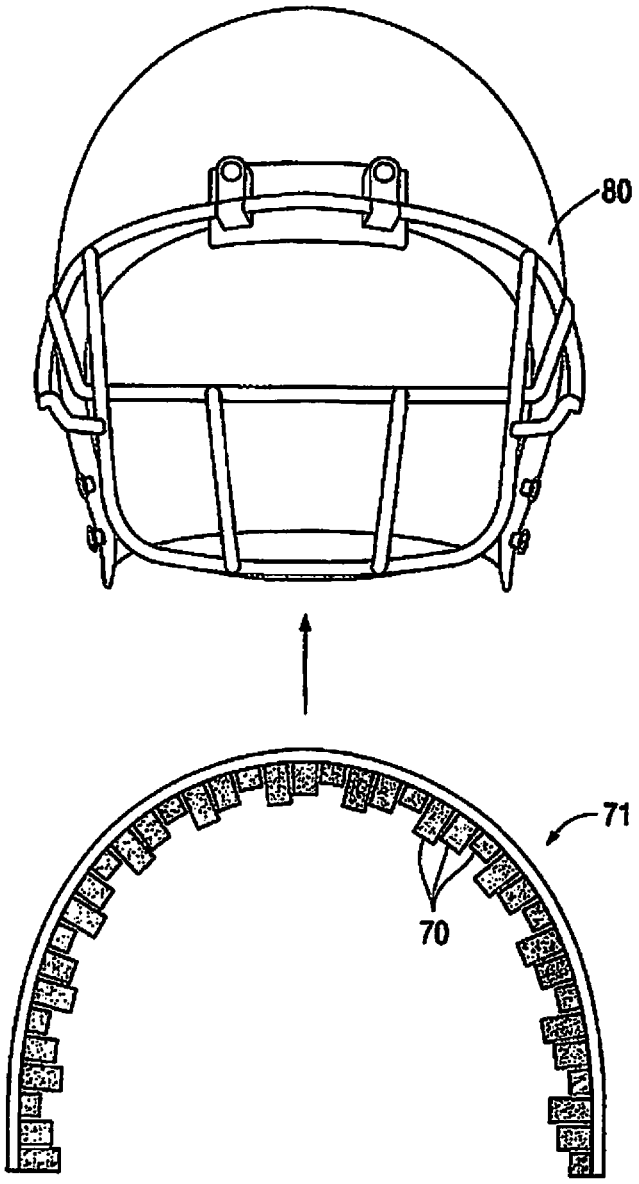
FIG. 9 is a front view of an alternate embodiment of the helmet of the present invention having an inner liner insertable into a helmet.

The inner liner with the aforedescribed shock absorbing features can be provided as a non-removable component attached to the helmet e.g., helmet 20. Alternatively, as shown in the embodiment of FIG. 9, the inner liner 71 with shock absorbers 70 can be a separate component insertable into a conventional helmet 80 and attached thereto by various methods such as adhesive or clips or other known methods. The liner 71 shown in FIG. 9 has the shock absorbers of FIG. 2A but other liners with other shock absorbers described herein e.g., shock absorbers 50 or 60, could also be provided as attachable and/or removable inner liners.

Figure 4C:
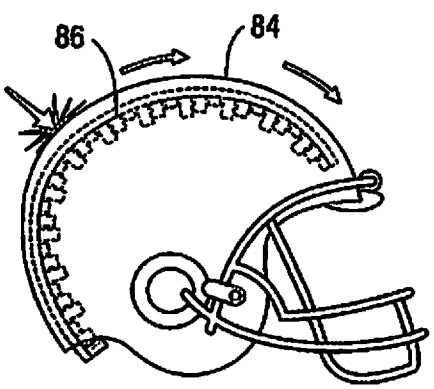
FIG. 4C is a side view illustrating rotation of the outer body of FIG. 4A upon impact at a rear region of the helmet.
Figure 4B:
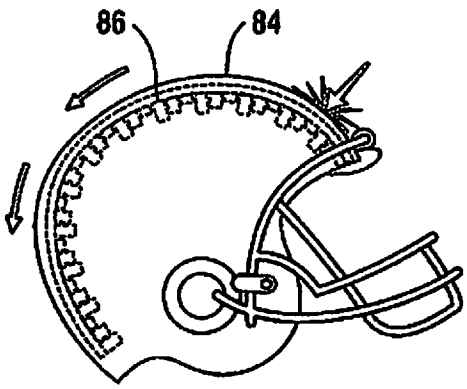
FIG. 4B is a side view illustrating rotation of the outer body of FIG. 4A upon impact at a front region of the helmet.
Figure 4A:
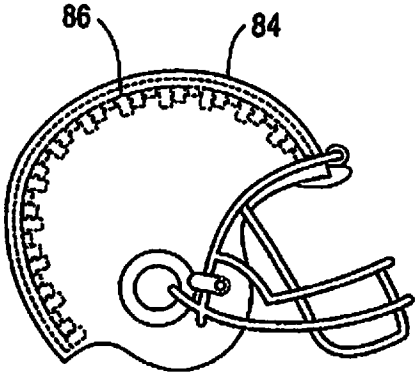
FIG. 4A is a side view of an alternate embodiment of the helmet of the present invention having a rotatable outer body, the helmet shown prior to impact.

The outer shell of the helmet of the present invention in some embodiments can be rotatable with respect to the helmet body. This helps to deflect the force to minimize direct hit impact. This is shown for example in FIGS. 4B and 4C, represented by the directional arrow showing for example a front impact causing rotation of the outer body 84 with respect to the inner liner 86 and FIG. 4C illustrating rotation of the outer body 84 upon a rear impact force. The outer shells of the helmets (with associated shock absorbers) of the other embodiments disclosed herein can likewise in some embodiments be rotatably mounted to the helmet body so they can rotate as in FIGS. 4B and 4C.

In some embodiments, any of the aforedescribed helmets can have a low friction outer surface, and even an enhanced slippery outer surface, by providing a low friction coating or low friction outer layer to aid in a glancing or deflecting rather than a direct hit. That is, the lower friction outer surface deflects the force to the helmet.

Figure 10A:
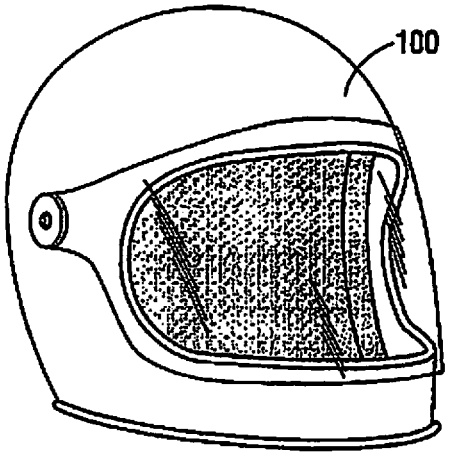
FIG. 10A is a perspective view of a motorcycle helmet having an inner liner of the present invention.
Figure 10B:
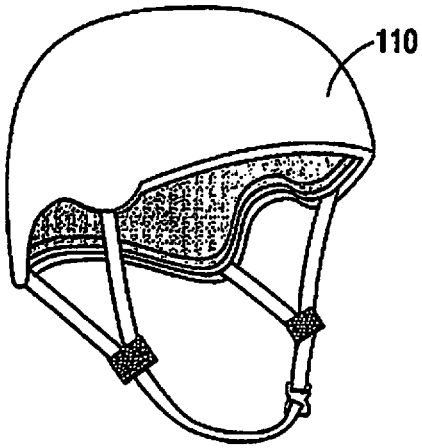
FIG. 10B is a perspective view of a bicycle helmet having an inner liner of the present invention.
Figure 10C:
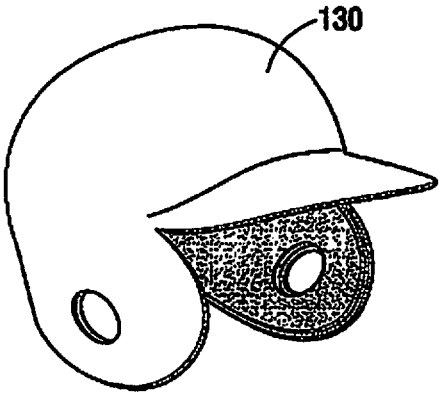
FIG. 10C is a perspective view of a baseball helmet having an inner liner of the present invention.

Helmets for other sports and uses are also contemplated. FIGS. 10A-10C show examples of different helmets which can contain any of the inner liners and shock absorbers of the present invention described herein, either permanently attached or as an attachable (mountable) insert as in FIG. 9. FIG. 10A illustrates a motorcycle helmet 100, FIG. 10B illustrates a bicycle helmet 110 and FIG. 10C illustrates a baseball batter's helmet 130. Other helmets are also contemplated including for example helmets for lacrosse, field hockey, etc.

While the above description contains many specifics, those specifics should not be construed as limitations on the scope of the disclosure, but merely as exemplifications of preferred embodiments thereof. Those skilled in the art will envision many other possible variations that are within the scope and spirit of the disclosure as defined by the claims appended hereto.

What is claimed is:

1. A helmet comprising an outer shell having an inner surface and an outer surface and a plurality of shock absorbers, the plurality of shock absorbers being positioned internal of the outer shell and extending from a common surface, the plurality of shock absorbers including:

at least one first shock absorber defining a first height such that the at least one first shock absorber includes a first shock absorption characteristic;

at least one second shock absorber defining a second height different than the first height such that the at least one second shock absorber includes a second shock absorption characteristic different than the first shock absorption characteristic; and at least one third shock absorber defining a third height different than the first height and the second height such that the at least one third shock absorber includes a third shock absorption characteristic different than the first shock absorption characteristic and the second shock absorption characteristic, wherein the at least one first shock absorber includes a first set of shock absorbers having the first shock absorption characteristic, the least one second shock absorber includes a second set of shock absorbers having the second shock absorption characteristic, and the least one third shock absorber includes a third set of shock absorbers having the third shock absorption characteristic, wherein the first, second, and third sets of shock absorbers each comprise air cells, each air cell forming an air pocket, wherein the air cells of the first set of shock absorbers include a first relief valve releasing pressure when a first pressure threshold is exceeded, wherein the air cells of the second set of shock absorbers include a second relief valve releasing pressure when a second pressure threshold is exceeded different than the first pressure threshold, and wherein the air cells of the third set of shock absorbers include a third relief valve releasing pressure when a third pressure threshold is exceeded different than the first pressure threshold and the second pressure threshold.

2. The helmet of claim 1, wherein the first height is greater than the second height and the second height is greater than the third height.

3. The helmet of claim 1, wherein the helmet includes an inner liner and the outer shell spins with respect to the inner liner of the helmet to release energy and thereby facilitate dispersion of force resulting from an impact to the helmet.

4. The helmet of claim 1, wherein the outer surface of the outer shell has a low friction surface to deflect impact to the helmet.

5. The helmet of claim 1, wherein the first shock absorption characteristic provides a lower activation threshold than the second shock absorption characteristic and the second shock absorption characteristic provides a lower activation threshold than the third shock absorption characteristic such that activation of the first, second, and third sets of shock absorbers is dependent on the force impact to the helmet.

6. The helmet of claim 1, wherein a first gradient of stress absorption of the first set of shock absorbers differs from a second gradient of stress absorption of the second set of shock absorbers and the second gradient of stress absorption differs from a third gradient of stress absorption of the third set of shock absorbers, thereby providing successive loading based on severity of force impact to the helmet.

7. A helmet for diffusing and dispersing a force provided by an impact to the helmet, the helmet comprising an inner liner, an outer shell and a plurality of shock absorbing members positioned internal of the outer shell and extending from the inner liner, an outer surface of the shell having a low friction surface to deflect the force to the helmet by aiding glancing rather than a direct hit, the plurality of shock absorbing members having a varying gradient of shock absorption to provide successive loading based on severity of the force impact, the outer shell being rotatable with respect to the inner liner to minimize direct hit impact, wherein the plurality of shock absorbing members includes:

a first set of shock absorbers each defining a first height such that the first set of shock absorbers includes a first gradient of shock absorption;

a second set of shock absorbers each defining a second height different than the first height such that the second set of shock absorbers includes a second gradient of shock absorption different than the first gradient of shock absorption; and a third set of shock absorbers each defining a third height different than the first height and the second height such that the third set of shock absorbers includes a third gradient of shock absorption different than the first gradient of shock absorption and the second gradient of shock absorption, wherein the first, second, and third sets of shock absorbers each comprise air cells, each air cell forming an air pocket and wherein the air cells of the first set of shock absorbers include a first relief valve releasing pressure when a first pressure threshold is exceeded, wherein the air cells of the second set of shock absorbers include a second relief valve releasing pressure when a first pressure threshold is exceeded different than the first pressure threshold, and wherein the air cells of the third set of shock absorbers include a third relief valve releasing pressure when a third pressure threshold is exceeded different than the first pressure threshold and the second pressure threshold.

8. The helmet of claim 7, wherein the first height is greater than the second height and the second height is greater than the third height.

* * * * *